US008230804B1

(12) United States Patent
Barbieri

(10) Patent No.: US 8,230,804 B1
(45) Date of Patent: Jul. 31, 2012

(54) ENCLOSED CHAMBER, ADJUSTABLE FINISH-APPLICATOR FOR FLAT AND DIMENSIONAL SURFACES

(75) Inventor: Michael Barbieri, Bozeman, MT (US)

(73) Assignee: P&B Construction, Inc., Bozeman, MT (US)

( * ) Notice: Subject to any disclaimer, the term of this patent is extended or adjusted under 35 U.S.C. 154(b) by 185 days.

(21) Appl. No.: 12/573,626

(22) Filed: Oct. 5, 2009

Related U.S. Application Data

(63) Continuation of application No. 29/323,946, filed on Sep. 3, 2008, now Pat. No. Des. 601,597.

(51) Int. Cl.
*B05C 1/08* (2006.01)
*B05D 1/28* (2006.01)

(52) U.S. Cl. ..... 118/222; 118/224; 118/249; 118/255; 118/261; 118/262; 427/355; 427/356; 427/428.11; 427/428.14

(58) Field of Classification Search ..... 118/221, 118/222, 224, 249, 255, 256, 261, 262; 101/216, 101/479, 480; 162/360.2; 427/428.11, 428.14, 427/355, 356, 428.01; 100/155 R, 168, 172
See application file for complete search history.

(56) References Cited

U.S. PATENT DOCUMENTS

| | | | | |
|---|---|---|---|---|
| 169,520 | A | 11/1875 | Chambers | |
| 3,800,702 | A * | 4/1974 | Roberts | 101/425 |
| 4,653,303 | A | 3/1987 | Richard | |
| 4,976,817 | A | 12/1990 | Correa et al. | |
| 4,986,873 | A | 1/1991 | Hamamura | |
| 5,007,445 | A | 4/1991 | Pender | |
| 5,240,545 | A | 8/1993 | Washizaki et al. | |
| 5,372,670 | A | 12/1994 | Cummings et al. | |
| 5,385,610 | A * | 1/1995 | Deerer et al. | 118/241 |
| 5,389,185 | A | 2/1995 | Washizaki | |
| 5,960,714 | A * | 10/1999 | Gottling et al. | 101/216 |
| 6,273,976 | B1 | 8/2001 | Oliver et al. | |
| 6,405,779 | B1 * | 6/2002 | Wittkopf | 156/555 |
| 6,482,265 | B1 * | 11/2002 | Falck et al. | 118/681 |
| 6,668,715 | B1 * | 12/2003 | Biro et al. | 101/32 |
| 7,322,221 | B2 | 1/2008 | Lohr et al. | |
| 7,438,017 | B2 * | 10/2008 | Jabbari et al. | 118/44 |

* cited by examiner

*Primary Examiner* — Laura Edwards
(74) *Attorney, Agent, or Firm* — Sarah J. Rhoades

(57) ABSTRACT

This liquid applicator covers all sides of substantially flat and dimensional surfaces of boards or siding with stain or paint in a uniform manner. The applicator has an upper and lower series of rollers and wiping agents, a set of vertical rollers, and a paint collection assembly. Preferably, some of the upper rollers and some of the lower rollers will consist of horizontal wet-rollers which receive liquid from an outside source. The remaining rollers are horizontal dry-rollers which absorb, smooth and buff the surface. The vertical rollers coat the side aspects of a board. All rollers spread paint rapidly over all board surfaces in a uniform manner. The main components have adjustment features: the rollers move vertically and toggle clamps and the like permit custom selection and sizing for each of the rollers and wipers. A catch pan has a drain plug at or near its lowest point.

22 Claims, 9 Drawing Sheets

ENCLOSED CHAMBER, ADJUSTABLE FINISH-APPLICATOR FOR FLAT AND DIMENSIONAL SURFACES

CROSS-REFERENCE TO RELATED APPLICATIONS

This continuation patent application claims priority under 35 U.S.C. §120 to U.S. patent D601,597 S Design patent application Ser. No. 29/323,946, entitled "Enclosed Chamber, Adjustable Finish-Applicator for Flat and Dimensional Surfaces", and issued on Oct. 6, 2009 and filed on Sep. 3, 2008. Applicant incorporates that patent by reference.

BACKGROUND

1. Field of Invention

This invention relates to a new and useful mechanical means of covering a flat and dimensional surface such as a board or piece of vinyl siding with liquid, such as paint and stain, and more particularly relates to a machine incorporating roller applicators.

2. Description of Related Art

In the construction industry it is necessary for laborers to paint or stain the surfaces of boards or other building materials prior to or during the construction of housing and office structures. This wet liquid application process slows and detracts from the more specialized labor used in the construction of building structures. The time and care required to paint boards after they are applied to the building makes such an option prohibitive. Moreover, applying liquid to untreated board will cause them to contract and can result in unsightly and unwieldy gaps in constructed structures. Similarly, while it is desirable to paint or stain boards prior to applying them to the building structure, this is often not a practical option as a clean, dry location may be hard to come by on a job site. In order to affect the complete application to all sides of a board, large amounts of time and care must be taken to allow each surface to dry between applications.

It is known that rollers are an effective tool to apply paint to a board-type surface. However, the time, mess and work area required to use standard roller tools can be prohibitive. A need exists for a portable machine to aid in the efficient and effective application of paints and stains to boards prior to constructing buildings.

Inventions in other fields have sought to use conveyor-belt assemblies to more securely place various film coatings like photoresist on printed electronic circuit boards or panel materials. Mechanical solutions have also been applied in very large-scale, industrial mills. These specialized machines have not been applied to the building construction industry in any analogous manner. No invention has sought to provide a small, portable design which can effectively cover materials at construction-site locations. A successful product would save time and money and prevent an aesthetically displeasing or cluttered and disorderly job site.

BRIEF SUMMARY OF THE INVENTION

The present invention is an adjustable finish applicator machine created to help speed the process of staining and painting wood boards, vinyl siding panels, and the like (herein, a "workpiece" or "work piece"). The applicator is an apparatus for contemporaneously applying liquid coating to all surfaces of a work piece. It comprises a frame, a series of vertical and horizontal supports, a series of horizontal and vertical rollers which apply a liquid covering to the work piece, and squeegee-type wiping surfaces.

The frame is generally shaped like a rectangular prism with four upright legs, two upper horizontal side supports affixed to the upright legs, two lower horizontal side supports affixed to the upright legs, two upper end horizontal supports perpendicularly affixed to the upper horizontal side supports and affixed to the upright legs, and two lower horizontal supports perpendicularly mounted to the lower horizontal side supports. The rollers and wipers of the invention are mounted to the frame with the assistance of mounting supports. The first, or upper mounting support spans the horizontal cross-section of the frame. It is movably attached to the upright legs so that it can be raised and lowered in order to accommodate work pieces of varying depths. A lower, second mounting support is affixed to the upright legs in another horizontal cross-section of the frame.

The lower mounting support may also be movable but preferably remains affixed to the frame for additional support and the upper mounting support is moved up and down to accommodate varying depths. Mounted upon each of the first and second mount supports are a number of rotary cylindrical applicator assemblies, or rollers. As will be understood, the rollers are rotatably attached to the mounting supports to allow them to turn and evenly coat the surface of a work piece.

The rollers are preferably provided in opposing pairs. Thus, for each roller attached to the first mounting support, another roller will be attached to the second mounting support in an opposing manner. Ideally, the rollers will be set vertically to one another in a parallel, opposed plane. Any number of pairs are permitted, but in the preferred embodiment shown and discussed herein, three upper horizontal rollers offset three lower horizontal rollers. In addition, at least two vertical rollers are provided to aid in the covering of the sides of a work piece. In the preferred embodiment, the vertical rollers are attached to the first, upper mounting support. The rollers used in the present invention may be of a standard type known in the industry. For example, the horizontal rollers have body formed of a core, a cap, and a cover. The core is desirably perforated with holes to allow liquid—delivered to the rollers via tubing from a liquid supply source—to permeate the cover portion of the roller. In addition to being permeable, the cover is fabricated of a material suited to evenly spreading a liquid across the surface of the work piece. The cap serves as the attachment point for the rollers as well as the end point for the liquid flow. The rollers are attached to the respective, first or second, mounting supports so that they may rotate.

The applicator also includes squeegee-type wiping surfaces as a means to remove excess liquid paint or stain from the work piece before it exits the unit. A first wiping surface is horizontally affixed to the upper, first mounting support. A second wiping surface is horizontally affixed to the lower, second mounting support. The respective wiping surfaces are vertically displaced from the one another in a parallel, opposing plane. Any excess liquid removed from the work piece is forced to the sides of the work piece and into a tray at or near the bottom of the unit. The tray forms a collection or catch pan which has a slanted bottom surface. The slant of the bottom surface reaches its lowest point at or near a drain spigot. The spigot may be used to collect or re-circulate and recycle paint or stain.

Importantly, the first, upper mounting support may be adjusted and follow a trapezoidal screw in order to move or slide vertically along the vertical support legs of the frame. The movement of the upper mounting support is a means to adjust the height of first mounting support in relation to the second mounting support. The adjustment is aided by the use of a timing pulley, cranking or clamping system. With this adjustment, work pieces of differing depths may be accommodated.

The present invention provides an automated or manually assisted machine with a unique methodology to stain or paint work pieces more quickly and efficiently than traditional methods. The use of the applicator allows laborers to save time and material which translates to lower costs and money savings. Job sites are kept clean of unnecessary debris and stains. Work pieces varying up to nine inches wide and four inches deep are serviced by this unique and original applicator which coats all sides and edges of work pieces.

The foregoing has outlined, in general, the physical aspects of the invention and is to serve as an aid to better understanding the more complete detailed description which follows. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow.

DETAILED DESCRIPTION OF THE INVENTION

Figure 1:
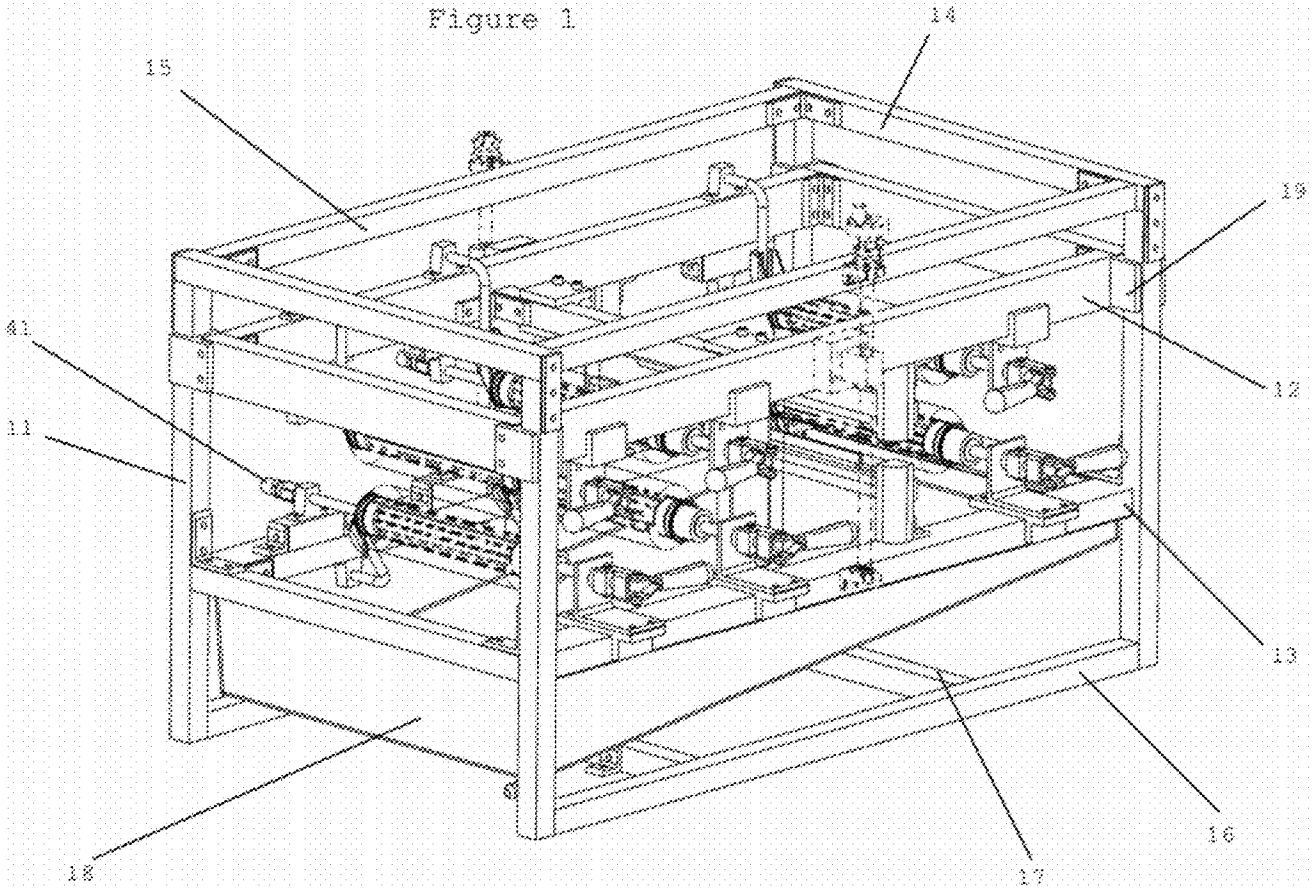
FIG. 1 is a side perspective view of the Adjustable Finish-Applicator for Flat and Dimensional Surfaces.

FIG. 1 sets out the frame of the enclosed chamber, adjustable finish-applicator for flat and dimensional surfaces. The shape of the frame is generally a rectangular prism. This device is primarily used for the application of liquid, stain or paint (herein may be referred to as "liquid") onto pre-cut boards or siding; thus, the frame is sized and shaped to be of appropriate width and height to receive such boards. The applicator is supported by four upright, vertical frame legs 11 which serve as a point of attachment for all of the horizontal structural frame members of the device. The applicator is additionally supported by upper horizontal side frame members 15, upper horizontal end frame members 14, lower horizontal side frame members 16, and lower horizontal cross bar frame members 17. The operating features—rollers and wipers—are attached to horizontal mounting supports. The first, or upper mounting support 12 is a rectangle in shape and spans the horizontal cross-section of the frame. According to the embodiment shown in FIG. 1, the upper mounting support 12 is movably attached to the upright legs 11 by a single flange linear bearing 19 so that it can be raised and lowered in order to accommodate work pieces of varying depths. A lower, second mounting support 13 is affixed to the upright legs 11. The lower mounting support 13 is also in the shape of a rectangle and spans the horizontal cross-section of the frame. In FIG. 1 the affixation is accomplished by 4-hole corner brackets and screws. The lower mounting support 13 may also be movable, but preferably remains affixed to the frame for additional support. In the FIG. 1 and the other drawings, it will be appreciated that 4-hole corner brackets and 3-hole plates with accompanying screws or bolts are used as hardware to hold the device in place. This is but one means to assemble the frame. Any known alternative may be used including welding, stamping, or clamping. Any other variation of fabrication or material should be considered apparent as an alternative embodiment of the present invention.

Figure 2:
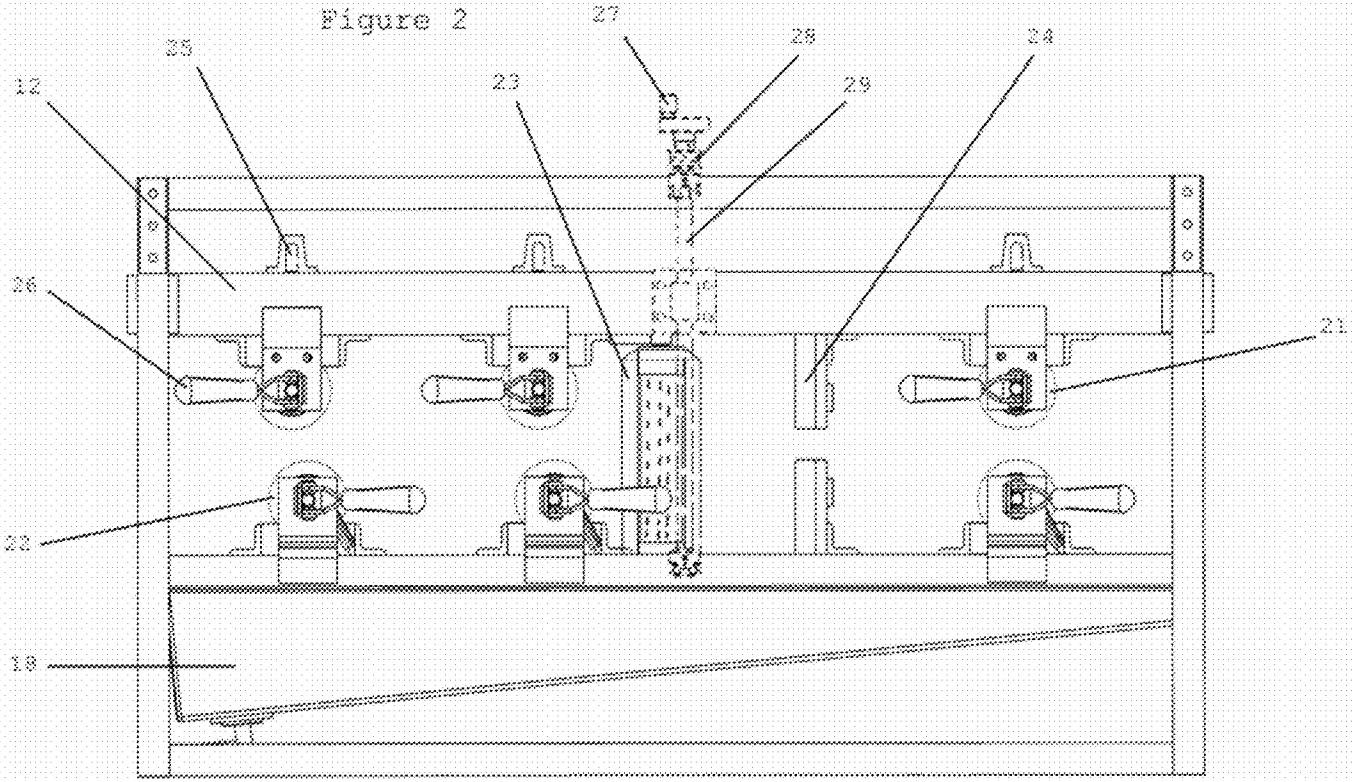
FIG. 2 is a right, side plan view of the Adjustable Finish-Applicator for Flat and Dimensional Surfaces.
Figure 3:
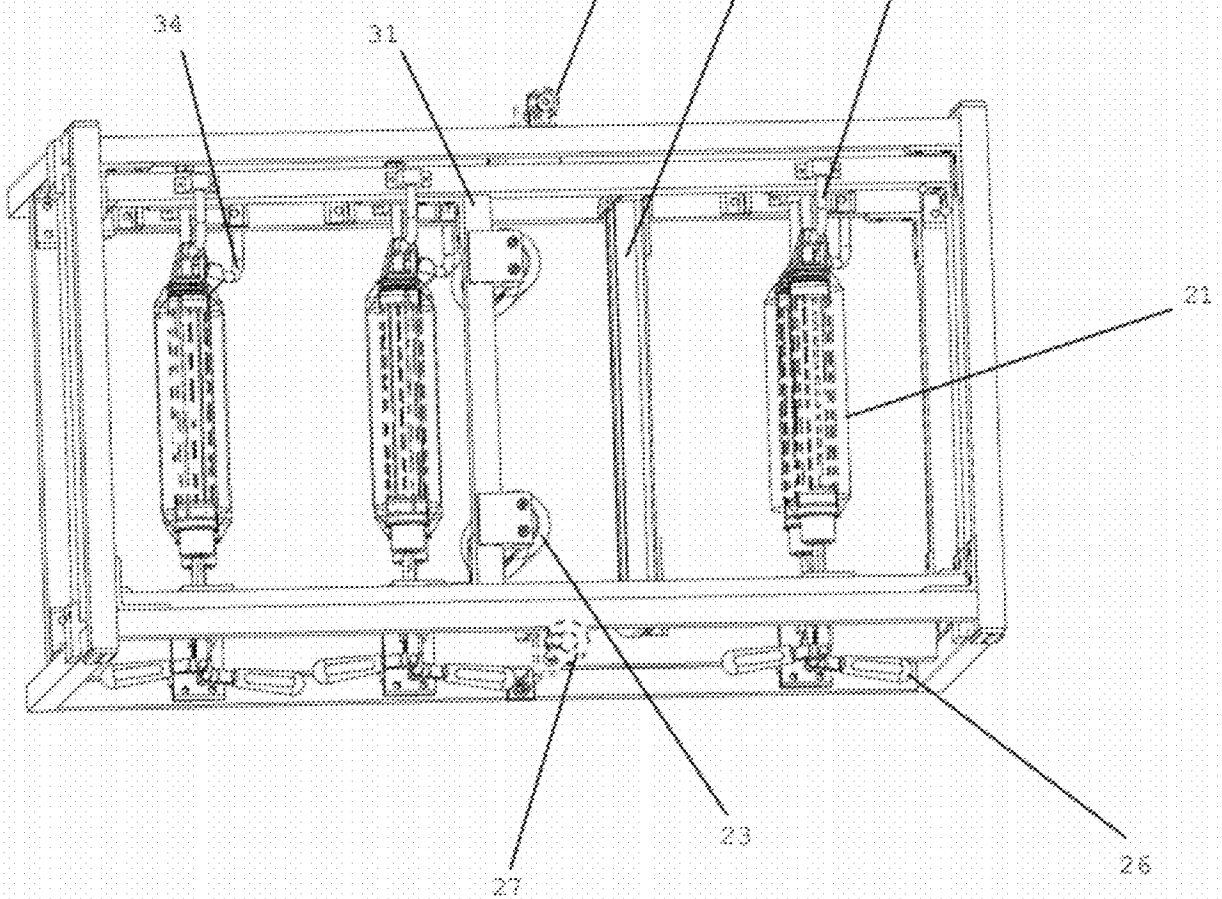
FIG. 3 is a top perspective view of the Adjustable Finish-Applicator for Flat and Dimensional Surfaces.

As visible in FIG. 2, a number of rotary cylindrical applicator assemblies, or rollers are mounted upon each of the first and second mounting supports. The rollers are rotatably attached to the mounting supports to allow them to turn and evenly coat the surface of a work piece. Six horizontal rollers are demonstrated in FIG. 2. Upper rollers 21 are rotatably attached to the upper mounting support 12. Lower rollers 22 are rotatably attached to the lower mounting support 13. While rotation is vital to the operation of the applicator, the rollers must also be sufficiently supported and yet able to be changed out. The rollers are supported by roller retaining rods 25. The toggle assembly 26 permits the removal and replacement of rollers. Preferably, some of the upper rollers and some of the lower rollers will be wet-rollers meaning they are supplied with the liquid via the compression tube fit adapter 41. The remaining rollers should consist of horizontal dry-rollers. The final rollers to contact the work piece before the work piece exits the applicator will be a set of paint-absorbing and buffing dry-rollers. Two vertical rollers 23 are provided in the preferred embodiment and coat side aspects of a work piece. FIG. 3 demonstrates the second vertical roller 23. In the preferred embodiment, the vertical rollers 23 are attached and rotate from a cross bar 31 which traverses and is affixed to the upper roller mounting support 12. The vertical rollers 23 could alternatively be affixed to the lower roller mounting support or alternately affixed to either. Other variations in fabrication will also be apparent.

Each of the upper and lower mounting supports has a wiping assembly 24 affixed to it (See FIG. 2) via a wiping assembly cross bar 32 (see FIG. 3). The wiping assemblies 24 move excess liquid away from the work piece surface. Once away from the work piece surface, excess liquid must exit the applicator. This occurs via dripping of the liquid into a tray located near the lower horizontal side frame member 16 where it is directed to the lower slant of the collection pan 18. As best viewed in FIG. 6, a spigot 61 is located at or near the lowest portion of the drip pan 18 slant. The spigot 61 may be used to aid in the collection or re-circulation and recycling of liquid, paint or stain.

FIGS. 1-5 aid in the illustration of the preferred embodiment's upper mounting support 12 movement. The upper mounting support 12 is attached in a manner to allow vertical movement in order to accommodate varying work piece depths. The raising action permitted by the bearings 19 is actuated by the crank assembly 27 engaging the crank-side timing pulley 28 and non-crank side timing pulley 33 with the respective, crank-side trapezoidal screw 29 and the non-crank side trapezoidal screw 44. The preferred trapezoidal screws 29 will have one end single stepped and one end double stepped. The movement of the upper mounting support 12 is furthered by hardware (such as socket set screws, L-brackets, steel blocks, flanged bushings, and snap rings shown here). While hardware actually used may vary, the type implemented must aid with vertical actuation of the first mounting support. The FIG. 4 front end view illustrates the adjustable portions of the respective crank assembly 27 and non-crank timing pulley 33. In some figures, the height-adjustment assemblies are shown in broken or phantom lines. This is only to aid in the viewing of the numerous components within the chamber and should not be viewed as a disclaimer of the structure or functionality of these components. The crank-side trapezoidal screw 29 is coupled to the non-crank side trapezoidal screw 33 via a polymeric belt or similar connection (not shown in the figures). Any other variation of fabrication or material should be considered apparent as an alternative embodiment of the present invention.

Figure 4:
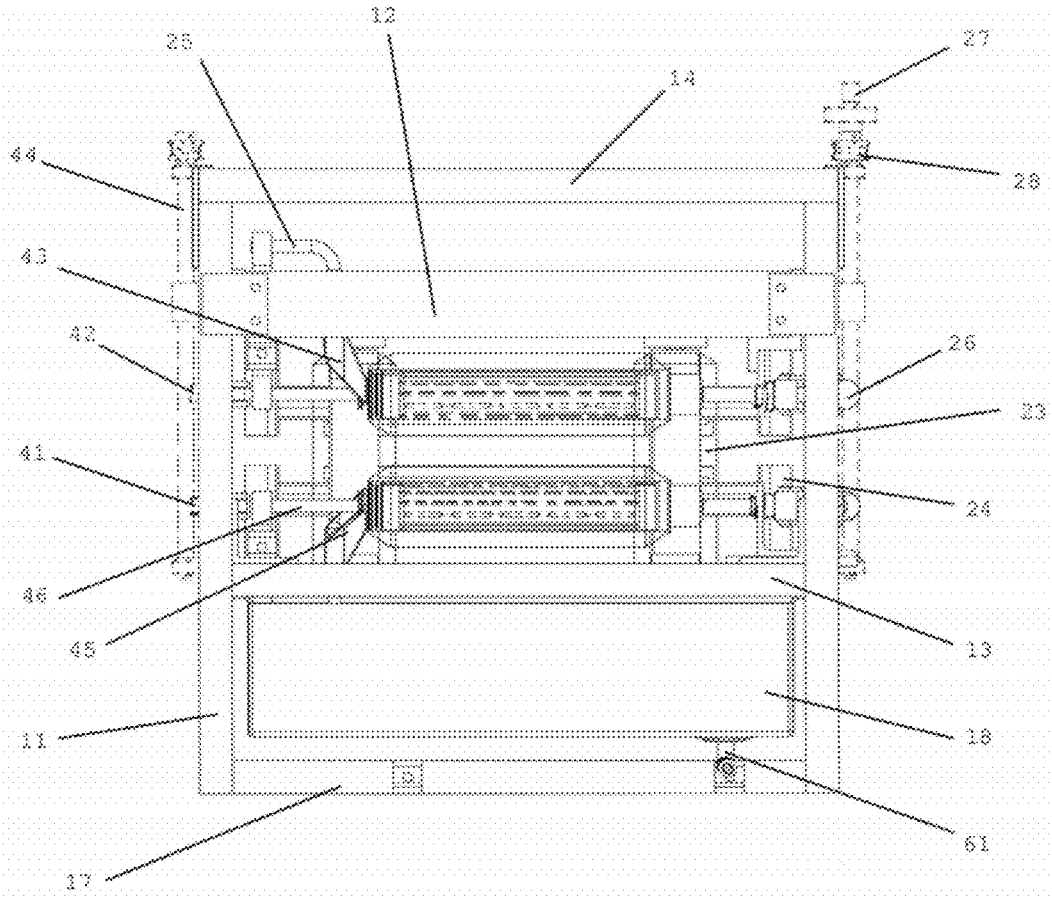
FIG. 4 is a front, end view of the Adjustable Finish-Applicator for Flat and Dimensional Surfaces. In the preferred embodiment, this is the work piece entry end.
Figure 5:
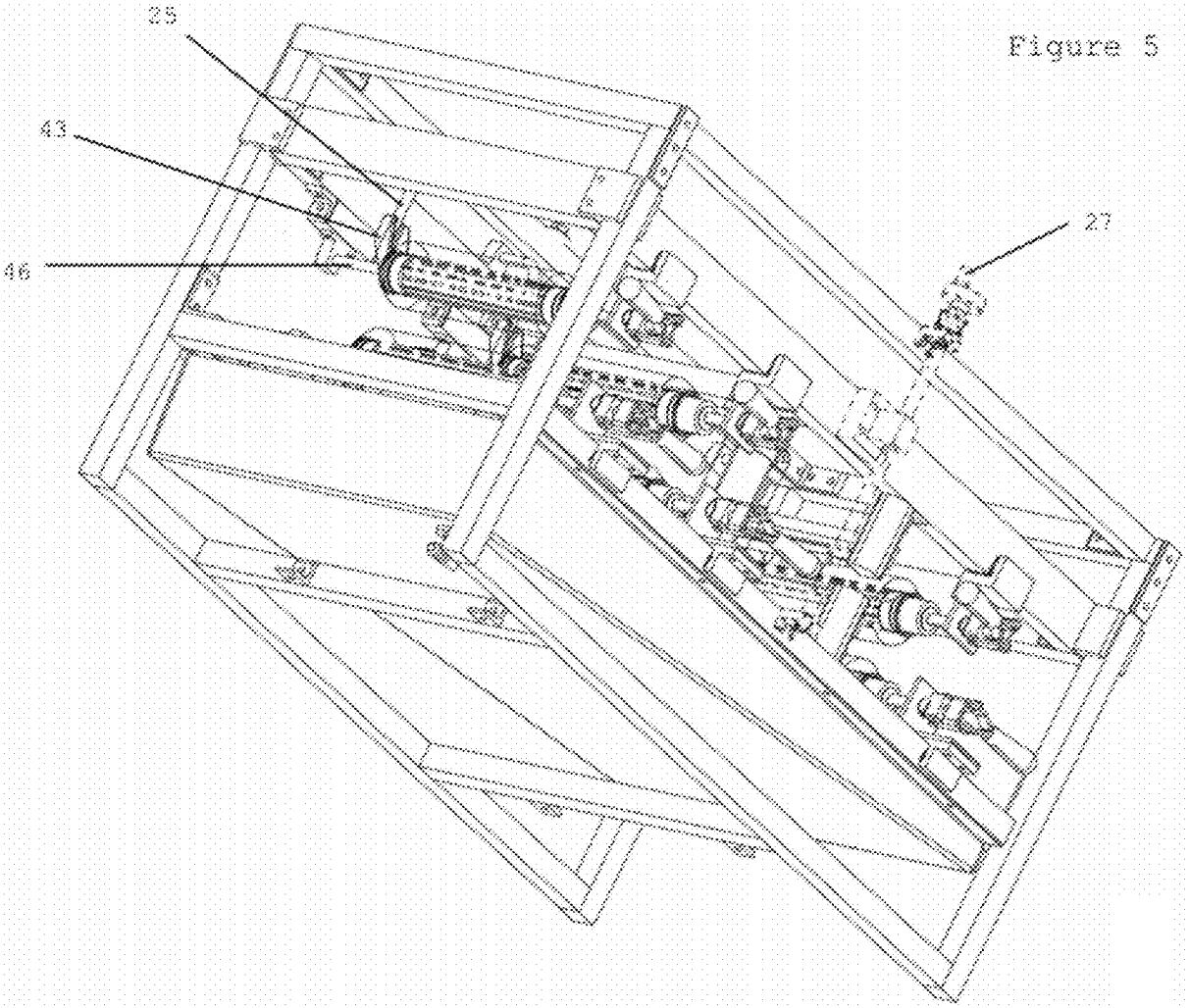
FIG. 5 is a bottom perspective view of the Adjustable Finish-Applicator for Flat and Dimensional Surfaces.

The structures permitting rotatable attachment of the rollers are shown in substantial part in the front end view of FIG. 4. The rollers whether upper or lower are held in place by their retaining rods. An upper retaining rod 25 is shown here and a lower retaining rod 34 is shown in FIG. 3. Each retaining rod is aided by a retaining fixture. An upper roller retaining fixture 43 and a lower roller retaining fixture 45 are shown in FIG. 4. Similar components are provided for the vertical rollers but are more difficult to view or are not shown due to visual interference from other components.

Liquid for application originates from outside the present invention. The liquid travels through feed lines (not shown) leaving the liquid storage location (not shown) by a pump or other known apparatus of a standard industry type (not shown). Feed lines attach to the wet-rollers via compression tube fit adapters which then transfer liquid from the lines to the cores of the rollers through supply rods 46. The upper compression tube fit adapter 41 and lower compression tube fit adapter 42 are demonstrated in FIG. 4. As can be appreciated, these adapters serve as liquid, paint, or stain inlets and coordinate with the wet-roller supply rods 46. Supply rods 46 not coordinating with a compression tube fit adapter will serve as dry supply rods, meaning the rollers attached thereto will serve as dry rollers and spread already applied liquid. Any other variation of fabrication, material, use, or application should be considered apparent as an alternative embodiment of the present invention. Wet-rollers may be selectively alternated to dry-rollers by valves. Wet-roller positioning may be changed depending on the objectives of coating desired or the behavior of the liquid being applied. All rollers are of a type and design known in the art.

Figure 6:
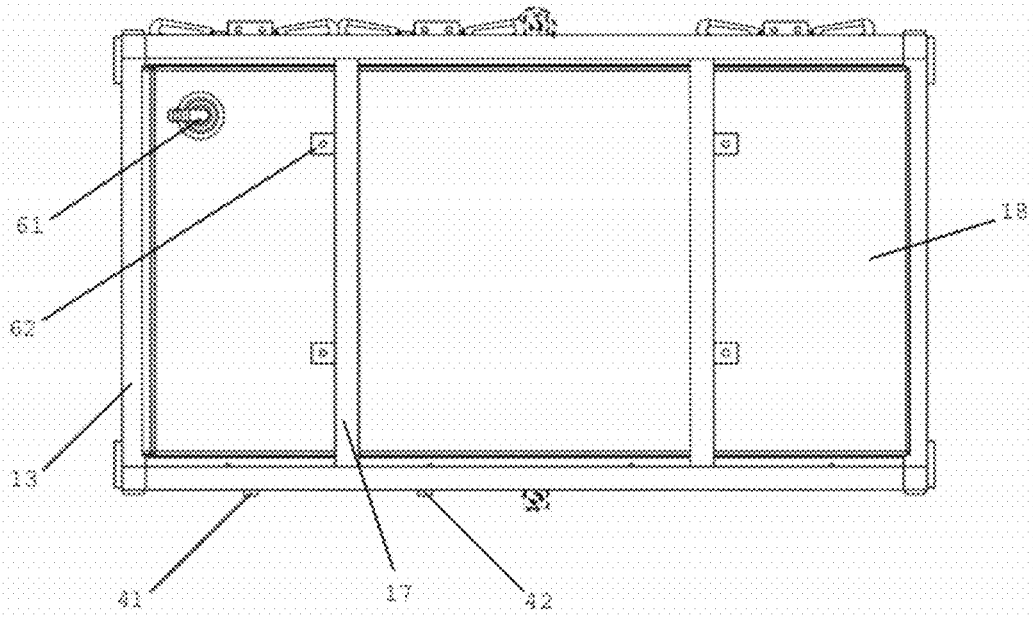
FIG. 6 is a bottom plan view of the Adjustable Finish-Applicator for Flat and Dimensional Surfaces.

FIG. 6 illustrates a bottom, plan view of the present invention. The respective positions of the drain spigot 61 and the lower horizontal cross frame member 17 are particularly demonstrated in FIG. 6. Attached to the cross frame member 17 is a 4-hole corner bracket hardware 62 which may be used by a laborer to affix the portable applicator to a table or other solid structure. Of course, the majority of the applicator is obscured from view by the collection pan 18 in this case fabricated of aluminum sheet metal at the bottom of the applicator. Any other variation of fabrication or material should be considered apparent as an alternative embodiment of the present invention.

Figure 7:
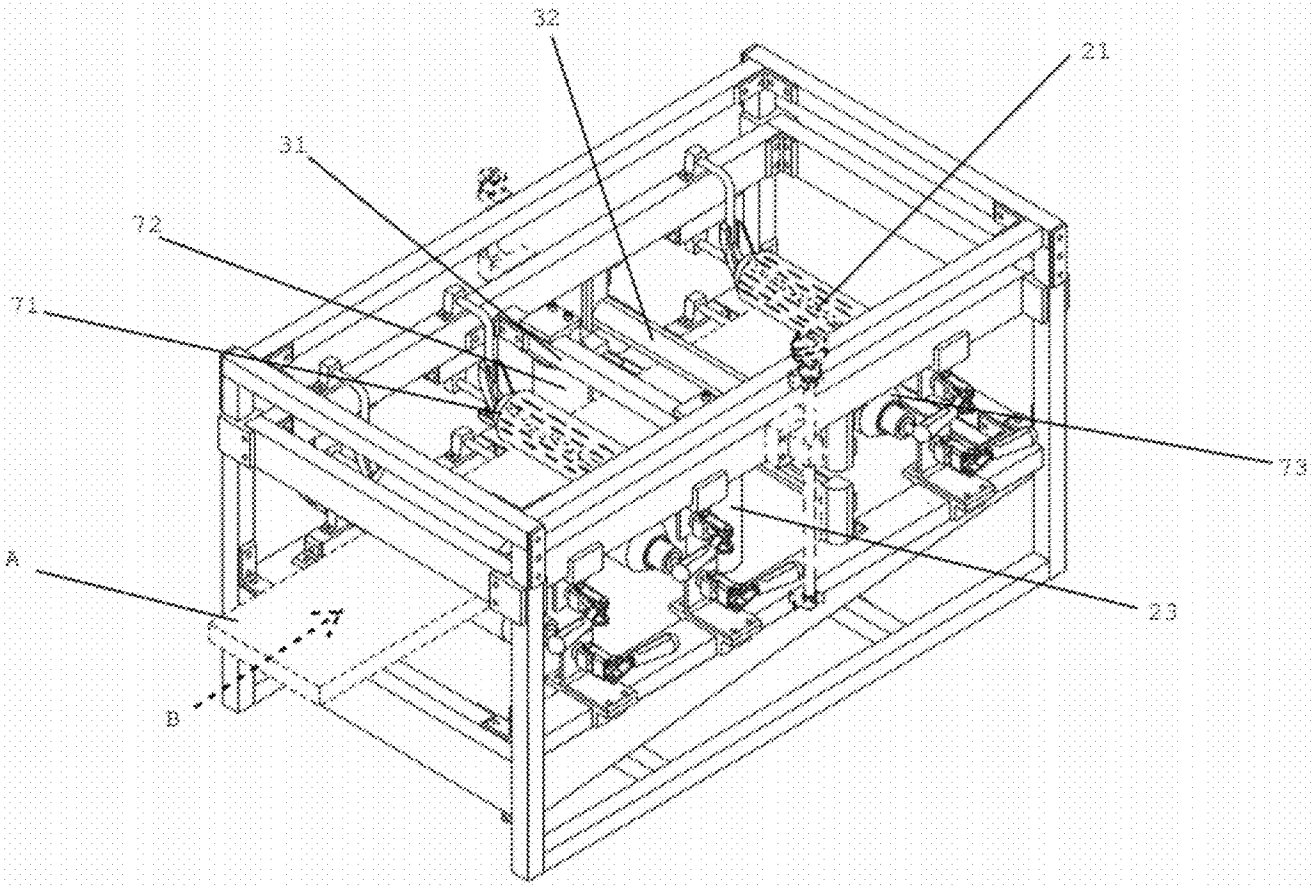
FIG. 7 is a side perspective view of the Adjustable Finish-Applicator showing, in phantom, a work piece having a sample flat and dimensional surface inserted therein.
Figure 8:
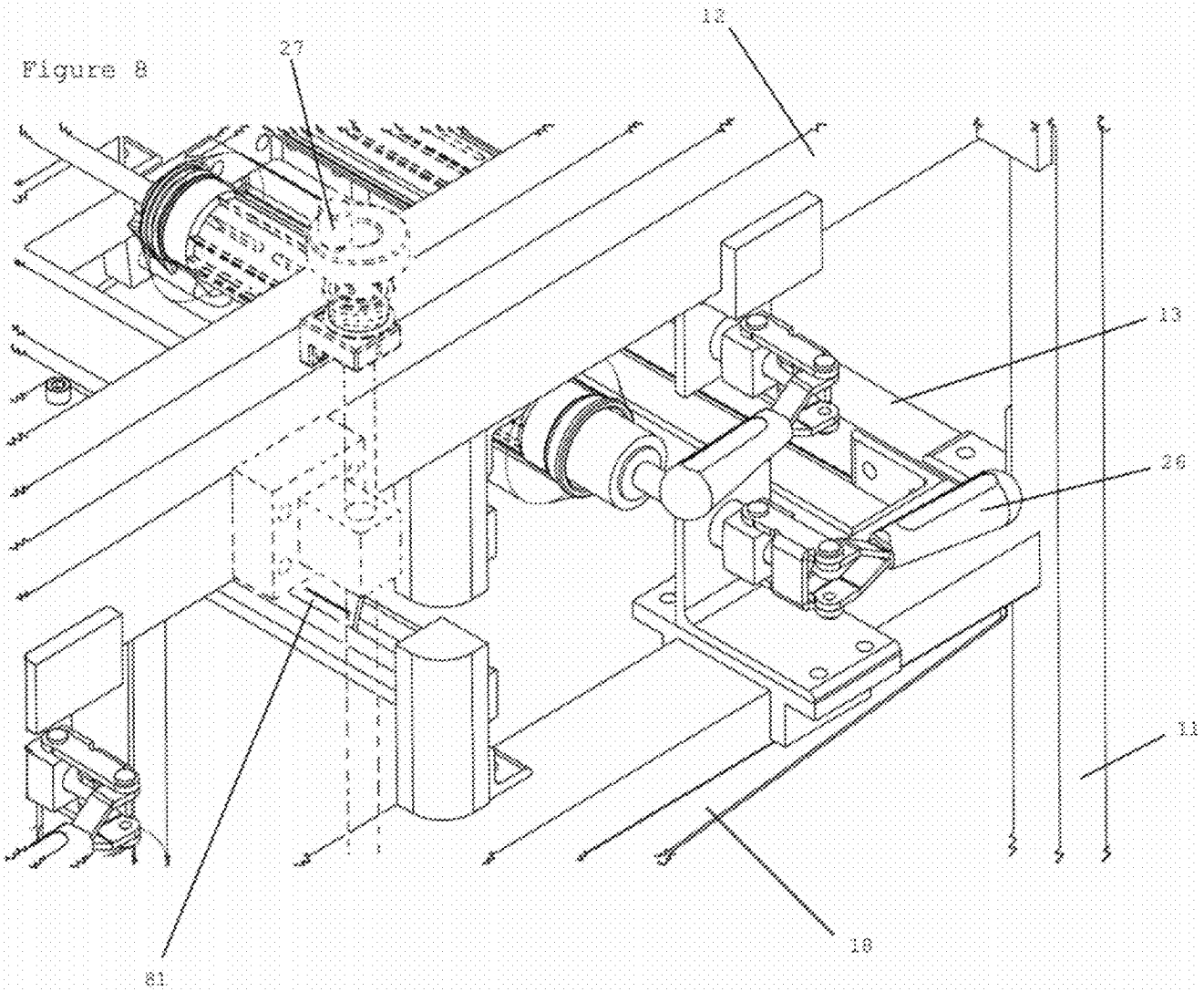
FIG. 8 is an enlarged, partial view of the Adjustable Finish-Applicator as demonstrated in FIG. 1.

The method of using the applicator becomes apparent in view of FIG. 7. In FIG. 7, a workpiece A is demonstrated being placed into the applicator in the direction indicated by Arrow B. In the preferred embodiment, the workpiece travels through the applicator and is coated with liquid by rollers 22 shown in prior figures. The liquid is smoothed by the rollers in line with the roller 71. The vertical rollers 23 and 72 smooth liquid over the side aspects of the work piece. Excess liquid is removed by the wiper assemblies 32 which include a rubber-type wiping surface 81 such as a squeegee of the type shown in larger view in FIG. 8. In the preferred embodiment, a final set of rollers (21 and 73) provide a smoothing or buffing finish to the work piece. The enclosed finish-applicator provides a unique method for the application of liquid onto a surface of a work piece using the device as shown and described. Each of the main components of the present invention have adjustment features. Toggle clamps or similar vice assemblies permit custom sizing, removal and replacement for each of the rollers and wiping surfaces. The pressure applied by the wiping surface 81 may be further adjusted via several screws or similar apparatus. Other variations may be possible.

Figure 9:
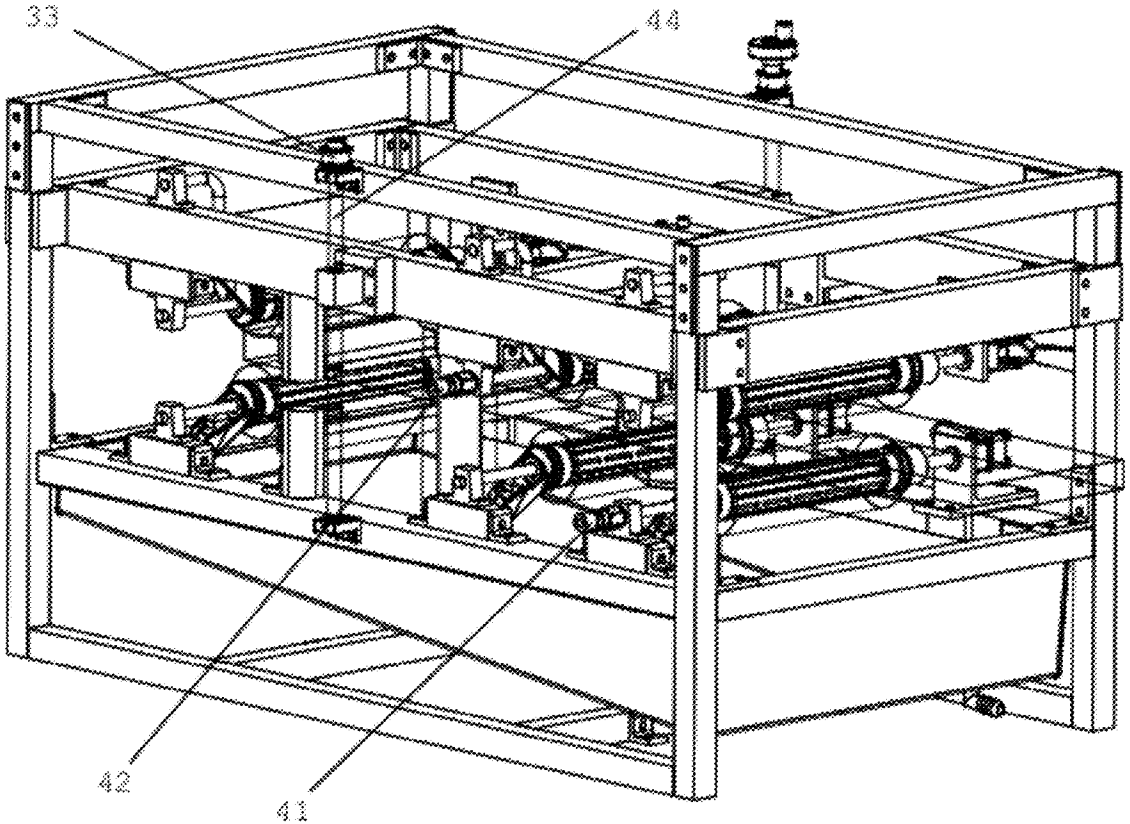
FIG. 9 is a left side, perspective view of the Adjustable Finish-Applicator.

FIG. 9 is a left side, perspective view of the present invention. When the applicator is viewed from this angle, the features of the wet-rollers including the compression tube fit adapters upper 42 and lower 41 can be viewed in relation to the other applicator components. The non-crank side timing pulley 44 and non-crank side timing pulley 33 are also more visible.

The rollers of the present invention are desirably of a standard type known in the industry. For example, the horizontal rollers have body formed of a core, cover, and cap. The core allows liquid to enter the roller. The cap may serve as the attachment point and may prevent the liquid from leaving the end of the roller. The cover is made of a spongy, soft or otherwise desirable, spreading material. The core may be perforated with holes to allow liquid—delivered to the rollers as described—through to the cover's spreading material. The spreading material in such an instance would be permeable to the liquid and allow it to flow through the cover where the material surface would evenly spread the liquid across the work piece.

The materials used to construct the preferred embodiment of the present invention are steel, aluminum or other similar material. Wood could be used for the construction of the applicator as well. Any other variation of fabrication or material should be considered apparent as an alternative embodiment of the present invention. The design is termed "enclosed" because it is housed in a frame. Optionally, the device may be enclosed within solid, opaque, or transparent side walls and the interior components accessed via a hinged door or access panel. The applicator should be sized and constructed to accept work pieces up to 9 inches wide and up to 4 inches deep. In use, the applicator allows approximately 1,000 square feet of material to be processed in about 40 minutes.

In operation, liquid is pumped to the rollers of the applicator and the liquid permeates through the roller's spongy cover assembly. Eventually, the liquid collects on the outer roller surface. It is at this point, the work piece to be coated is hand fed between the upper and lower roller assemblies in the direction indicated in FIG. 7, Arrow B. The present invention finishes a work piece by applying liquid to the work piece via direct contact between the rollers and the work piece, wiping excess liquid from the work piece, smoothing excess liquid on the work piece, and collecting and draining unused liquid in a base collection pan. Liquid collected in the collection pan may be conserved and reused. A drain, when used in cooperation with tubing (not shown), permits the unused liquid to be returned to the supply source. In one embodiment of the present invention, the first upper and lower roller to contact the work piece are wet-rollers used for the application of liquid onto the work piece. Next, a second set of horizontal rollers spread the liquid, then vertical rollers are used to smooth and even the liquid coating on the sides of the work piece. An upper and lower wiping assembly remove excess liquid and help smooth the applied coat. After the work piece leaves the wiping assemblies, it passes through a final set of dry-rollers which aid in the final, smooth coating of the work piece. In addition to final smoothing, the final rollers also give stability to the work piece throughout the finish-applicator operation. After passing entirely through the finish-applicator the work piece is removed by hand and set aside for drying.

The present invention is a machine device which may be powered by mechanical, electrical, human or other means. The cranking system for lowering and raising the upper mounting support is contemplated to be actuated by hand, but of course any mechanical, electrical or electronic component advantages could also be employed. It is contemplated that the liquid delivery system would be powered by a pump, but such pump could be mechanically, electrically, or otherwise powered.

It is further intended that any other embodiments of the present invention which result from any changes in application or method of use or operation, method of manufacture, shape, size, or material which are not specified within the detailed written description or illustrations contained herein yet are considered apparent or obvious to one skilled in the art are within the scope of the present invention.

I claim:

1. An apparatus for applying a liquid to all surfaces of a substantially flat, dimensional work piece, comprising:

a frame formed in the shape of a rectangular prism,
 said frame comprising a plurality of upright legs and a plurality of horizontal frame members,
a first mounting support movably attached to the upright legs,
a second mounting support affixed to the upright legs,
 said second mounting support disposed below the first mounting support,
a plurality of rotary cylindrical applicator bodies,
a plurality of wiping surfaces,
a means to rotatably attach a plurality of rotary cylindrical applicator bodies to the first mounting support,
a means to rotatably attach a plurality of rotary cylindrical applicator bodies to the second mounting support,
a means to affix at least one wiping surface to the first mounting support,
a means to affix at least one wiping surface to the second mounting support,
a means to adjust the height of the first mounting support in relation to the second mounting support, and
a means to supply a liquid to at least one rotary cylindrical applicator body
wherein at least two of the rotary cylindrical applicator bodies are mounted perpendicular to at least two other rotary cylindrical applicator bodies.

2. The apparatus according to claim 1, wherein the supply means disperses liquid to a rotary cylindrical applicator body attached to the first mounting support.

3. The apparatus according to claim 1, wherein the supply means disperses liquid to a rotary cylindrical applicator body attached to the second mounting support.

4. The apparatus according to claim 1, wherein the supply means disperses liquid to one rotary cylindrical applicator body attached to the first mounting support and one rotary cylindrical applicator body attached to the second mounting support.

5. The apparatus according to claim 1, wherein the majority of the rotary cylindrical applicator bodies are affixed in a plane perpendicular to that of the upright legs.

6. The apparatus according to claim 1, wherein at least two of the rotary cylindrical applicator bodies are mounted in a plane parallel to that of the upright legs.

7. The apparatus according to claim 1, wherein the rotary cylindrical applicator bodies are vertically disposed from another rotary cylindrical applicator body in a parallel, opposing plane.

8. The apparatus according to claim 1, wherein the rotary cylindrical applicator bodies are formed and suited to applying and spreading liquid.

9. The apparatus according to claim 1, wherein at least one wiping surfaces is vertically opposed by at least one other wiping surface mounted in a parallel plane.

10. The apparatus according to claim 1, further comprising a collection tray and drain spigot assembly located in proximity of the lower horizontal frame members.

11. An apparatus for applying a liquid to all surfaces of a substantially flat, dimensional work piece, comprising:

a frame formed in the shape of a rectangular prism,
 said frame comprising a plurality of upright legs and a plurality of horizontal frame members,
a first mounting support movably attached to the upright legs,
a second mounting support affixed to the upright legs,
 said second mounting support disposed below the first mounting support,
a plurality of rotary cylindrical applicator bodies,
a plurality of wiping surfaces,
a means to rotatably attach a plurality of rotary cylindrical applicator bodies to the first mounting support,
a means to rotatably attach a plurality of rotary cylindrical applicator bodies to the second mounting support,
a means to affix at least one wiping surface to the first mounting support,
a means to affix at least one wiping surface to the second mounting support,
a means to adjust the height of the first mounting support in relation to the second mounting support, and
a means to supply a liquid to at least one rotary cylindrical applicator body,
wherein the means to adjust the height of the first mounting support in relation to the second mounting support comprises a trapezoidal screw, a crank, and a pulley system.

12. The apparatus according to claim 11, wherein at least two of the rotary cylindrical applicator bodies are communicatively connected to a supply of liquid.

13. The apparatus according to claim 11, wherein at least one of the rotary cylindrical applicator bodies attached to the first mounting support is communicatively connected to a supply of liquid and at least one of the rotary cylindrical applicator bodies attached to the second mounting support is communicatively connected to a supply of liquid.

14. The apparatus according to claim 11, further comprising a collection tray and drain spigot assembly located in proximity of the lower horizontal frame members.

15. The apparatus according to claim 11, wherein the rotary cylindrical applicator bodies are formed and suited to applying and spreading liquid.

16. A method of applying a liquid to a work piece comprising the steps of:

providing an apparatus of claim 10,
pumping liquid into and through at least one rotary cylindrical applicator body, hand-feeding a work piece between the first mounting support and second mounting support, applying the liquid to the work piece by effecting direct contact between the rotary cylindrical applicator bodies and the work piece, wiping excess liquid from the work piece via contact with at least one wiping surface, smoothing excess liquid on the work piece via at least two rotary cylindrical applicator bodies, and collecting and draining unused liquid in the base collection tray and drain spigot assembly, and removing the work piece from the apparatus.

17. An apparatus for applying a liquid to all surfaces of a substantially flat, dimensional work piece, comprising:

a frame having the shape of a rectangular prism and further comprising, four upright legs, two upper horizontal side supports affixed to the upright legs, two lower horizontal side supports affixed to the upright legs, two upper end horizontal supports perpendicularly affixed to the upper horizontal side supports and affixed to the upright legs, two lower horizontal supports perpendicularly mounted to the lower horizontal side supports, a first mounting support movably attached to the upright legs, a second mounting support affixed to the upright legs, said second mounting support located below the first mounting support, a plurality of rotary cylindrical applicator bodies rotatably attached to the first mounting support, at least two rotary cylindrical applicator bodies being mounted to the first mounting support in a horizontal manner, the horizontal rotary cylindrical applicator bodies being formed and suited to applying and spreading liquid on the surface, at least two rotary cylindrical applicator bodies being mounted to the first mounting support in a vertical manner, a plurality of rotary cylindrical applicator bodies rotatably attached to the second mounting support, at least two rotary cylindrical applicator bodies being mounted to the second mounting support in a horizontal manner, the rotary cylindrical applicator bodies being formed and suited to applying and spreading liquid on the surface, wherein the rotary cylindrical applicator bodies attached to the second mounting support are vertically disposed from the rotary cylindrical applicator bodies attached to the first mounting support in parallel, opposing planes, at least two wiping surfaces, a first wiping surface being horizontally affixed to the first mounting support, at second wiping surface being horizontally affixed to the second mounting support, wherein the first wiping surface is vertically disposed from the second wiping surface in a parallel, opposing plane, a means to supply the liquid to at least one rotary cylindrical applicator body, a means to adjust the height of the first mounting support in relation to the second mounting support, wherein the means to adjust the height of the first mounting support in relation to the second mounting support comprises at least one crank and a pulley system, and a collection tray assembly located in proximity of the lower horizontal supports of the frame, the collection tray assembly comprising a solid bottom to catch any spills during function of the apparatus and the collection tray assembly further comprising a drain spigot, the solid bottom of the collection tray assembly being downwardly angled toward the drain spigot.

18. The apparatus according to claim 17, wherein the rotary cylindrical applicator bodies further comprise:

a core, a cap, and a cover, the cap serving as the attachment point of the rotary cylindrical applicator assembly, the cover fabricated of a material suited to evenly spreading a liquid across the surface of the board, the core of at least one of the rotary cylindrical applicator bodies communicatively attached to a supply of liquid via tubing.

19. The apparatus according to claim 17, wherein the supply means disperses liquid to a rotary cylindrical applicator body attached to the first mounting support.

20. The apparatus according to claim 17, wherein the supply means disperses liquid to a rotary cylindrical applicator body attached to the second mounting support.

21. The apparatus according to claim 17, wherein the supply means disperses liquid to one rotary cylindrical applicator body attached to the first mounting support and one rotary cylindrical applicator body attached to the second mounting support.

22. A method of applying a liquid to a work piece comprising the steps of:

providing the apparatus of claim 17, pumping liquid into and through at least one rotary cylindrical applicator body, hand-feeding a work piece between the first mounting support and second mounting support, applying the liquid to the work piece by effecting direct contact between the rotary cylindrical applicator bodies and the work piece, wiping excess liquid from the work piece via contact with at least one wiping surface, smoothing excess liquid on the work piece via at least two rotary cylindrical applicator bodies, and collecting and draining unused liquid in the base collection tray and drain spigot assembly, and removing the work piece from the apparatus.

* * * * *